US010688404B2

(12) United States Patent
Cao et al.

(10) Patent No.: US 10,688,404 B2
(45) Date of Patent: Jun. 23, 2020

(54) REMOTELY CONTROLLED TOY VEHICLE

(71) Applicant: Mattel, Inc., El Segundo, CA (US)

(72) Inventors: Kevin Cao, Reseda, CA (US); Sam Tsui, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 15/895,043

(22) Filed: Feb. 13, 2018

(65) Prior Publication Data

US 2018/0229135 A1 Aug. 16, 2018

Related U.S. Application Data

(60) Provisional application No. 62/459,493, filed on Feb. 15, 2017.

(51) Int. Cl.

| | |
|---|---|
| ***A63H 17/00*** | (2006.01) |
| ***A63H 30/04*** | (2006.01) |
| ***A63H 29/22*** | (2006.01) |
| ***A63H 17/26*** | (2006.01) |

(52) U.S. Cl.

CPC ..... *A63H 17/004* (2013.01); *A63H 17/262* (2013.01); *A63H 29/22* (2013.01); *A63H 30/04* (2013.01)

(58) Field of Classification Search

CPC .... A63H 17/004; A63H 17/262; A63H 29/22; A63H 30/04

USPC ..... 446/437

See application file for complete search history.

(56) References Cited

U.S. PATENT DOCUMENTS

| | | | | |
|---|---|---|---|---|
| 3,733,739 | A | 5/1973 | Terzian | |
| 4,902,271 | A | 2/1990 | Yoneda | |
| 5,727,985 | A * | 3/1998 | George | A63H 17/004 446/437 |
| 5,921,843 | A | 7/1999 | Skrivan | |
| 6,095,890 | A | 8/2000 | George | |
| 6,105,982 | A | 8/2000 | Howell | |
| 6,551,169 | B2 | 4/2003 | Jaffe | |
| 6,589,098 | B2 | 7/2003 | Lee | |
| 6,648,722 | B2 | 11/2003 | Lynders | |
| 6,692,333 | B2 | 2/2004 | Kislevitz | |
| 6,926,581 | B2 | 8/2005 | Lynders | |
| 7,234,990 | B2 | 6/2007 | Leonov | |
| 7,458,876 | B2 | 12/2008 | Laurienzo | |
| 7,494,398 | B2 | 2/2009 | Laurienzo | |
| 7,503,828 | B2 | 3/2009 | Lee | |

(Continued)

OTHER PUBLICATIONS

MightMouse74Reviews, The Dark Night Rises U-Command Bat-Pod With Remote Control by Thinkway Toys Toy Review!!, Jul. 26, 2012 https://www.youtube.com/watch?v=4iplKlbFatU Whole Video.*

*Primary Examiner* — John E Simms, Jr.
*Assistant Examiner* — Rayshun K Peng
(74) *Attorney, Agent, or Firm* — Edell, Shapiro & Finnan, LLC

(57) ABSTRACT

A remotely controlled toy vehicle includes a front assembly, a rear assembly, a drive mechanism, and a roll mechanism. The front assembly and the rear assembly each include at least one wheel and the drive mechanism includes a drive motor configured to drive at least one of the at least one wheel of the front assembly and the at least one wheel of the rear assembly. The roll mechanism includes a roll motor configured to roll one of the front assembly and the rear assembly with respect to the other of the front assembly and the rear assembly.

20 Claims, 8 Drawing Sheets

(56) References Cited

U.S. PATENT DOCUMENTS

| | | | | |
|---|---|---|---|---|
| 7,927,174 | B2 | 4/2011 | Kim | |
| 8,025,551 | B2 | 9/2011 | Torres | |
| 8,267,739 | B2 | 9/2012 | Ishibashi | |
| 8,734,199 | B2 * | 5/2014 | Bruder | A63H 17/12 446/431 |
| 8,758,079 | B2 | 6/2014 | Arnau Manresa | |
| 9,352,242 | B2 | 5/2016 | Rehkemper | |
| 9,409,616 | B2 | 8/2016 | Lu | |
| 2014/0065926 | A1 * | 3/2014 | Rehkemper | A63H 30/04 446/454 |
| 2014/0312587 | A1 | 10/2014 | Lu | |
| 2015/0274000 | A1 * | 10/2015 | Meager | B60K 7/00 440/12.66 |

* cited by examiner

REMOTELY CONTROLLED TOY VEHICLE

CROSS-REFERENCE TO RELATED APPLICATION

This application claims the benefit of U.S. Provisional Patent Application No. 62/459,493, filed Feb. 15, 2017, entitled "Remotely Controlled Toy Vehicle," the entire disclosure of which is incorporated by reference herein.

FIELD OF THE INVENTION

The present invention relates to remotely controlled vehicles and, in particular, to remotely controlled vehicles with multiple motors that can drive and execute stunts, including rolls or tumbles, in multiple driving positions or orientations.

BACKGROUND OF THE INVENTION

Remotely controlled vehicles, which are also referred to as remote control ("RC") vehicles, are well known and commonly used by children and adults for entertainment. RC vehicles are often battery powered and may take the form of cars, trucks, boats, planes, or any other type of vehicle. Moreover, conventional RC vehicles often drive forwards or backwards and can either drive straight or turn. New features that add entertainment value to an RC vehicle or enhance performance of an RC vehicle are continually desired.

SUMMARY OF THE INVENTION

According to at least one example embodiment of the present invention, a remotely controlled toy vehicle includes a front assembly, a rear assembly, a drive mechanism, and a roll mechanism. The front assembly and the rear assembly each include at least one wheel and the drive mechanism includes a drive motor configured to drive at least one of the at least one wheel of the front assembly and the at least one wheel of the rear assembly. The roll mechanism includes a roll motor configured to roll one of the front assembly and the rear assembly with respect to the other of the front assembly and the rear assembly.

According to other example embodiments of the present invention, a remotely controlled toy vehicle includes a first wheel assembly, a second wheel assembly, a drive mechanism, and a main body that includes a tumbling mechanism. The drive mechanism is configured to drive at least one of the first wheel assembly and the second wheel assembly. The main body is disposed between and coupled to the first wheel assembly and the second wheel assembly. The tumbling mechanism is configured to roll the first wheel assembly with respect to the second wheel assembly. In at least some of these embodiments, the drive mechanism is disposed in the second wheel assembly and operable to propel the remotely controlled vehicle regardless of an orientation of the first wheel assembly with respect to the second wheel assembly.

Additionally or alternatively, the main body may include a first portion coupled to the first wheel assembly and a second portion coupled to the second wheel assembly. In at least some of these embodiments, the first wheel assembly is swivably coupled to the first portion and may be swiveled to steer the remotely controlled vehicle. Still further, in some of these embodiments, the second wheel assembly is fixed to the second portion with respect to a longitudinal axis of the remotely controlled vehicle and the first wheel assembly is fixed to the first portion with respect to the longitudinal axis so that, in rolling the first wheel assembly, the tumbling mechanism rolls the first wheel assembly and the first portion with respect to the second wheel assembly and the second portion.

BRIEF DESCRIPTION OF THE DRAWINGS

Like reference numerals have been used to identify like elements throughout this disclosure.

DETAILED DESCRIPTION OF THE INVENTION

A remotely controlled toy vehicle (RC vehicle) is presented herein. Generally, the RC vehicle includes two wheel assemblies that are each configured to roll or tumble about a longitudinal axis (i.e., an axis passing through the front and back of the vehicle). That is, the wheel assemblies can roll with respect to each other (roll in terms of yaw, pitch, and roll, as opposed to rolling along a surface, which the wheel assemblies can also do). Moreover, in at least some embodiments, the RC vehicle includes a roll or tumbling mechanism that is configured to cause a front assembly of the RC vehicle (which includes a first wheel assembly) to roll about the longitudinal axis of the RC vehicle with respect to a rear assembly of the RC vehicle (which includes a second wheel assembly). Consequently, the RC vehicle can provide entertaining driving patterns and execute a variety of entertaining stunts, such as barrel rolls, flips, and spins (i.e., 180s).

The RC vehicle may also include a drive mechanism that is configured to propel the RC vehicle along a surface (i.e., pavement, grass, sand, etc.) regardless of the orientation of the wheel assemblies. In fact, the wheel assemblies may include substantially hemispherical outer edges to ensure the RC vehicle can drive when the wheel assemblies are in various angular orientations with respect to the support surface on which the RC vehicle is traveling. Consequently, the RC vehicle may continue to drive or travel as the wheel assemblies rotate and may seamlessly transition between driving and executing stunts, such as barrel rolls and 180 s.

Figure 1:
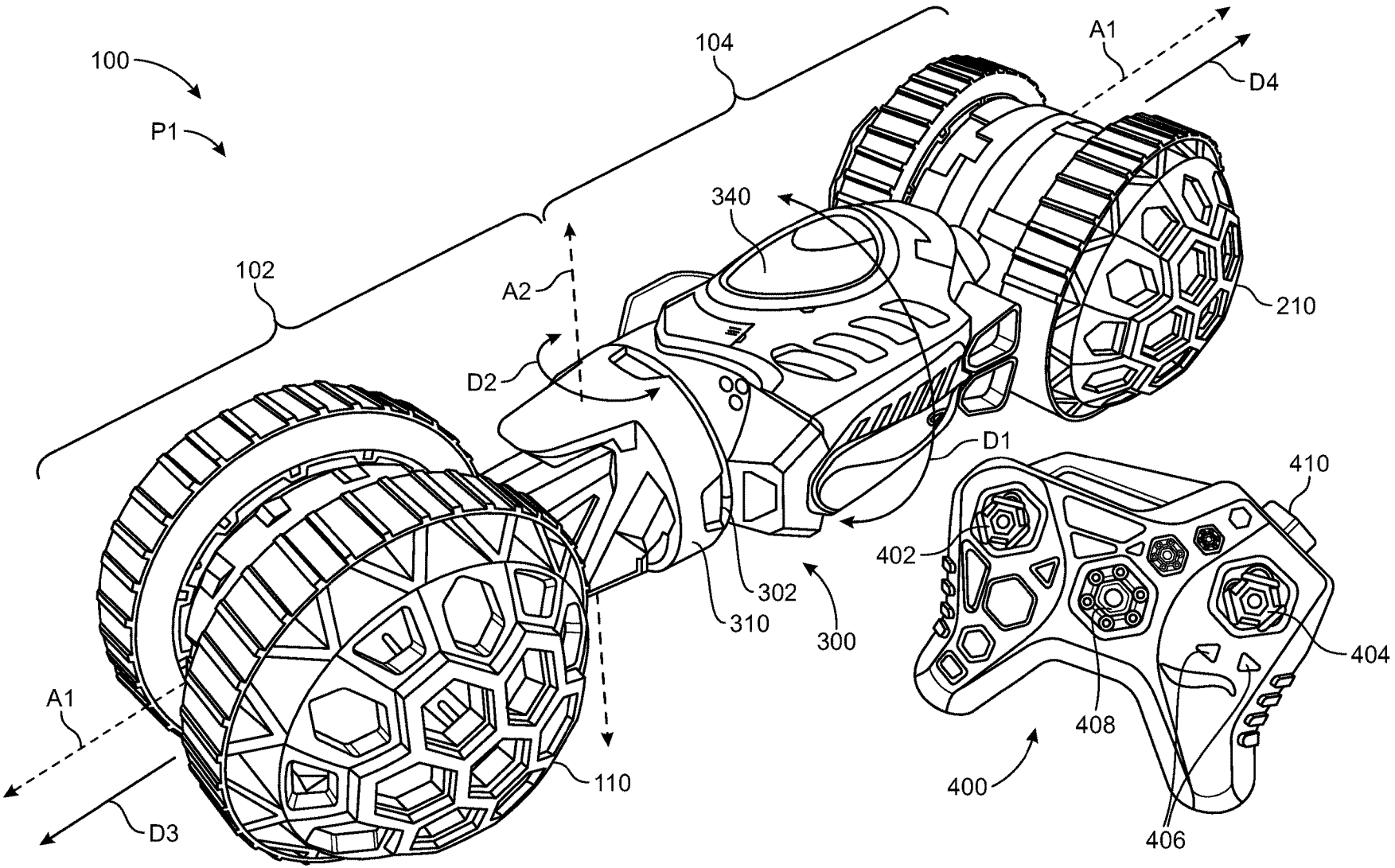
FIG. 1 illustrates a front perspective view of an exemplary embodiment of a remotely controlled toy vehicle (referred to herein as an RC vehicle) and an accompanying controller, according to the present invention.

Now referring to FIG. 1, an example embodiment of an RC vehicle 100 is illustrated in a first driving position P1. The RC vehicle 100 includes a first wheel assembly 110, a second wheel assembly 210, and main body 300. The main body 300 is coupled to the first wheel assembly 110 and the second wheel assembly 210 and extends therebetween. More specifically, the main body 300 includes a first portion 310 that is adjacent and coupled to the first wheel assembly 110 and a second portion 340 that is adjacent and coupled to the second wheel assembly 210. As is described in further detail below, the first portion 310 and the second portion 340 are rotatably coupled together at a rotation joint 302.

Collectively, the first wheel assembly 110 and the first portion 310 may be referred to as a first or front assembly 102 of the RC vehicle 100. Similarly, the second wheel assembly 210 and the second portion 340 may be collectively referred to as a second or rear assembly 104 of the RC vehicle 100. However, it is to be understood that the RC vehicle 100 can drive in either direction D3 or direction D4 and, thus, designations of "front" or "rear" may simply be used for clarity. For example, if the RC vehicle 100 is driving in direction D4, the rear assembly 104 may be the front of the RC vehicle 100 (or the RC vehicle 100 may be considered to be moving in reverse).

Generally, the front assembly 102 and the rear assembly 104 are each individually rotatable about a longitudinal axis A1 extending through the vehicle (i.e., in the directions denoted by arrow D1). That is, the front assembly 102 and the rear assembly 104 are rotatable about the longitudinal axis A1 with respect to each other. More specifically, the second portion 340 of the main body 300 is rotatably coupled, at the rotation joint 302, to the first portion 310 of the main body 300 so that the second portion 340 can rotate about the longitudinal axis A1 with respect to the first portion 310. Meanwhile, wheel assembly 110 and wheel assembly 210 are coupled to the main body 300 in a manner that prevents roll rotation (i.e., rotation about axis A1) of wheel assembly 110 and wheel assembly 210 with respect to the main body 300.

In particular, in the depicted embodiment, the first wheel assembly 110 cannot rotate about the longitudinal axis A1 with respect to the first portion 310 of the main body 300 and the second wheel assembly 210 cannot rotate about the longitudinal axis A1 with respect to the second portion 340 of the main body 300. Consequently, the first wheel assembly 110 rotates about longitudinal axis A1 (i.e., in the directions denoted by arrow D1) with the first portion 310 of the main body 300 and the second wheel assembly 210 rotates about longitudinal axis A1 (i.e., in the directions denoted by arrow D1) with the second portion 340 of the main body 300.

That being said, in at least some embodiments, wheel assembly 110 may be able to move or rotate with respect to the first portion 310 of the main body 300 without rotating about the longitudinal axis A1. For example, in the depicted embodiment, the first wheel assembly 110 is swivably coupled to the first portion 310 so that the first wheel assembly 110 can rotate, in in the directions denoted by arrow D2. That is, the first wheel assembly 110 can yaw about a vertical axis A2, as is described in further detail below in connection with FIG. 7. By comparison, in the depicted embodiment, the second wheel assembly 210 may be fixedly coupled to the second portion 340 of the main body 300.

As is described in further detail below, the aforementioned couplings (i.e., the swivel coupling of the first wheel assembly 110 to the first portion 310 and the fixed coupling of the second wheel assembly 210 to the second portion 340) may allow the first wheel assembly 110 to be used for steering while the second wheel assembly 210 to be used to power or propel the RC vehicle 100. However, in other embodiments, other couplings may be utilized while still allowing similar functionality. For example, in some embodiments, the second wheel assembly 210 may move or rotate about a yaw axis (parallel to axis A2) with respect to the second portion 340 of the main body 300. As another example, wheel assemblies 110 and 210 may each be rotatable about pitch axes (i.e., axes perpendicular to both axes A1 and A2) to allow for vertical movement of wheel assemblies 110 and 210 with respect to the main body 300 (i.e., to provide shocks or a shock-like movement).

Still referring to FIG. 1, the RC vehicle 100 is illustrated together with an example controller 400 that may be used to operate or drive the RC vehicle 100. In this particular embodiment, the controller includes a first joystick 402 and a second joystick 404 that can be used to drive the vehicle 100 (after powering on both the vehicle 100 (i.e., via a power switch, which is not shown in the Figures) and the controller 400 (i.e., via power button 408)). In particular, the first joystick 402 may be used to drive the RC vehicle 100 forwards (i.e., in direction D3) or backwards (i.e., in direction D4) by driving the rear wheel assembly 210 (i.e., by controlling a drive mechanism embedded in the second wheel assembly 210, as is described below in connection with FIGS. 6 and 8). Meanwhile, the second joystick 404 may be used to swivel the front wheel assembly 110 and control the steering of the toy vehicle 100 (i.e., by controlling a roll mechanism embedded in the main body 300, as is described below in connection with FIGS. 6-8).

Additionally, the controller 400 may include a booster button 410 and secondary buttons 406. The booster button 410 may switch the vehicle 100 from a normal operating mode to a "boosted mode." In the boosted mode, the vehicle 100 may be able to travel at faster speeds and perform additional stunts. For example, in the boosted mode, a speed governing function may be disabled. The secondary buttons 406 may provide different functions for the different modes. For example, when the booster button 410 is not actuated, the secondary buttons 406 may server as trim buttons to allow a user to adjust the alignment of the first assembly 102 with respect to the second assembly 104. Then, when the booster button 410 is actuated (i.e., depressed), the secondary buttons may be actuated to cause the RC vehicle 100 to move through predetermined paths, such as a 180 degree turn or a 90 degree turn.

Moreover, when the booster button 410 is depressed, the front assembly 102 may be free to roll with respect to the rear assembly 104. More specifically, when the booster button 410 is depressed, a roll mechanism included in the main body 300 may be free to spin or roll, as is described in further detail below. Depending on the grip and position of the first assembly 102 and the second assembly 104, this spinning will cause either the first portion 310 or the second portion 340 to roll or tumble, about the longitudinal axis A1, with respect to the other portion of the main body 300, as is also described in further detail below. Consequently, during operation, the RC vehicle 100 may move from a first driving position P1 to another driving position.

Figure 2:
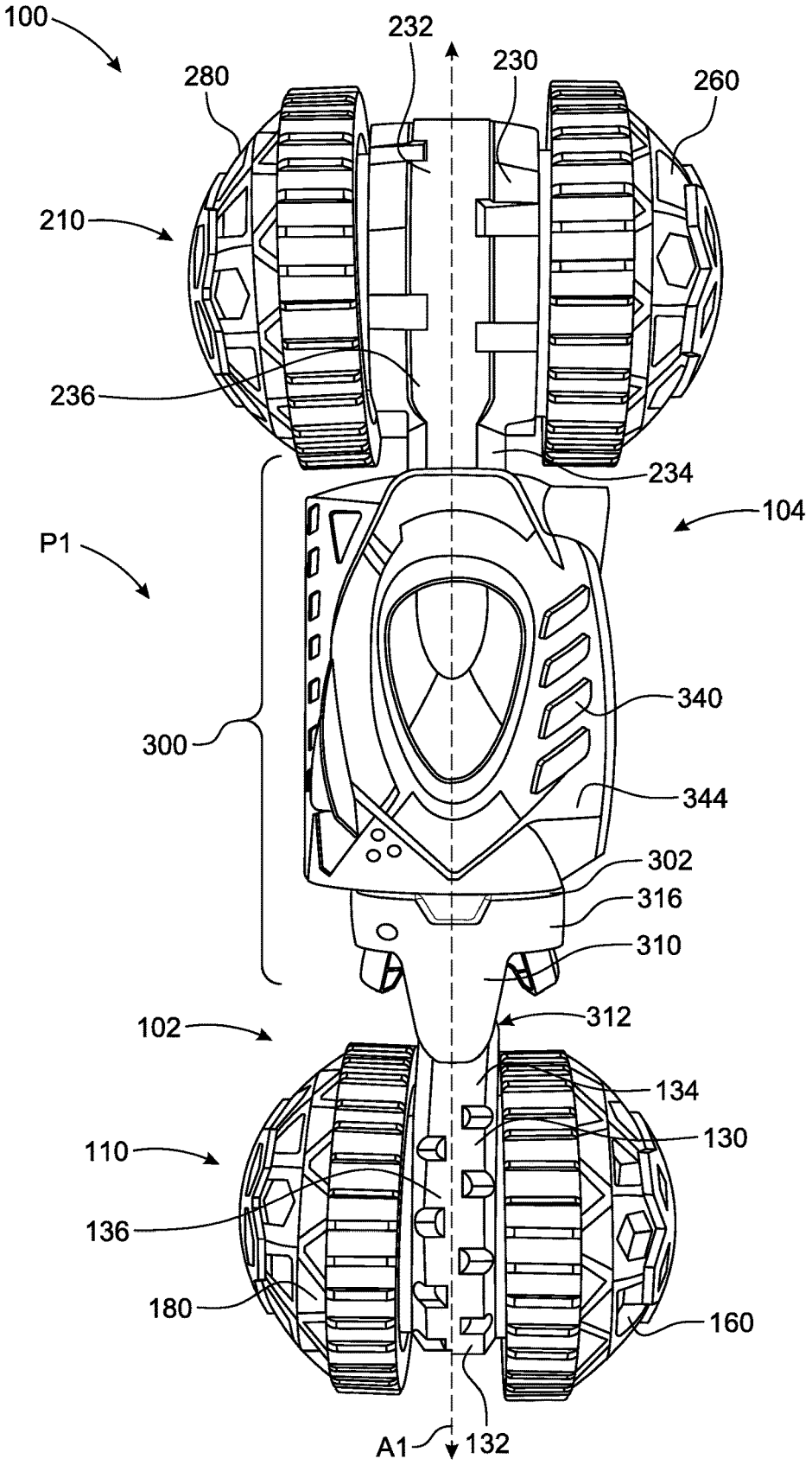
FIG. 2 illustrates a top view of the RC vehicle of FIG. 1 while the RC vehicle is in a first driving position.

Now referring to FIG. 2, the RC vehicle 100 is shown, from a top view, in the first driving position P1. In the first driving position P1, the first assembly 102 and the second assembly 104 are both right side up (insofar as the terms right side up, upside down, and any similar terms are used for clarity, with the understanding that the RC vehicle 100 may drive right side up, upside down, or other such positions, as is explained in further detail below). Consequently, a top 316 of the first portion 310 and a top 344 of the second portion 340 of the main body 300 can be seen from the top view provided in FIG. 2. By comparison, wheel assembly 110 includes wheels 160 and 180 that can constantly spin about a lateral axis (i.e., on an axle) and wheel assembly 210 includes 260 and 280 that can constantly spin about a lateral axis. Consequently, wheels 160, 180, 260, and 280 may not necessarily have a top or bottom like the portions of the main body 300. However, the pairs of wheels are each mounted on central hubs that have tops and bottoms that are aligned with the main body 300.

Figure 6:
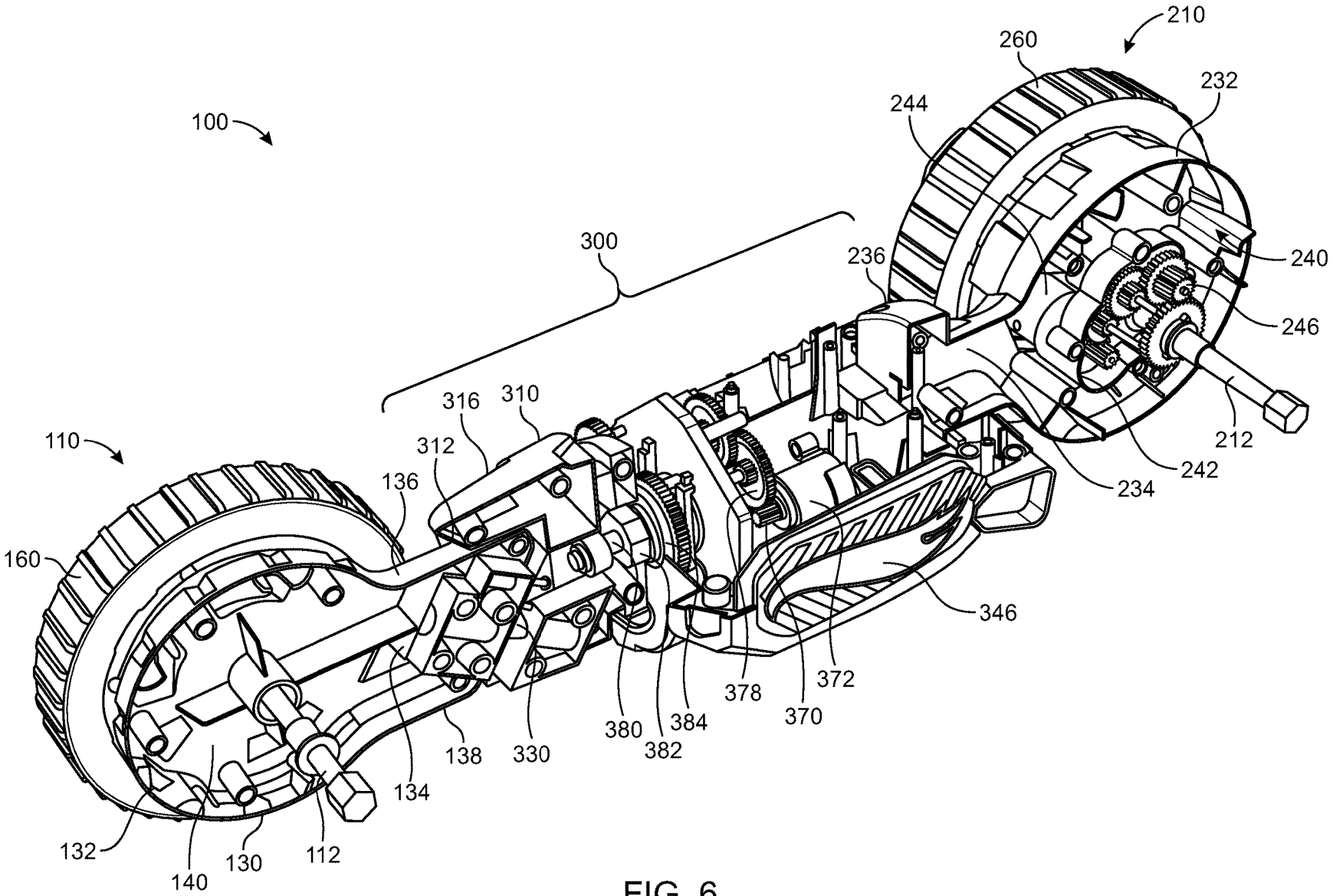
FIG. 6 illustrates a sectional, perspective view of a portion of the RC vehicle of FIG. 1.
Figure 7:
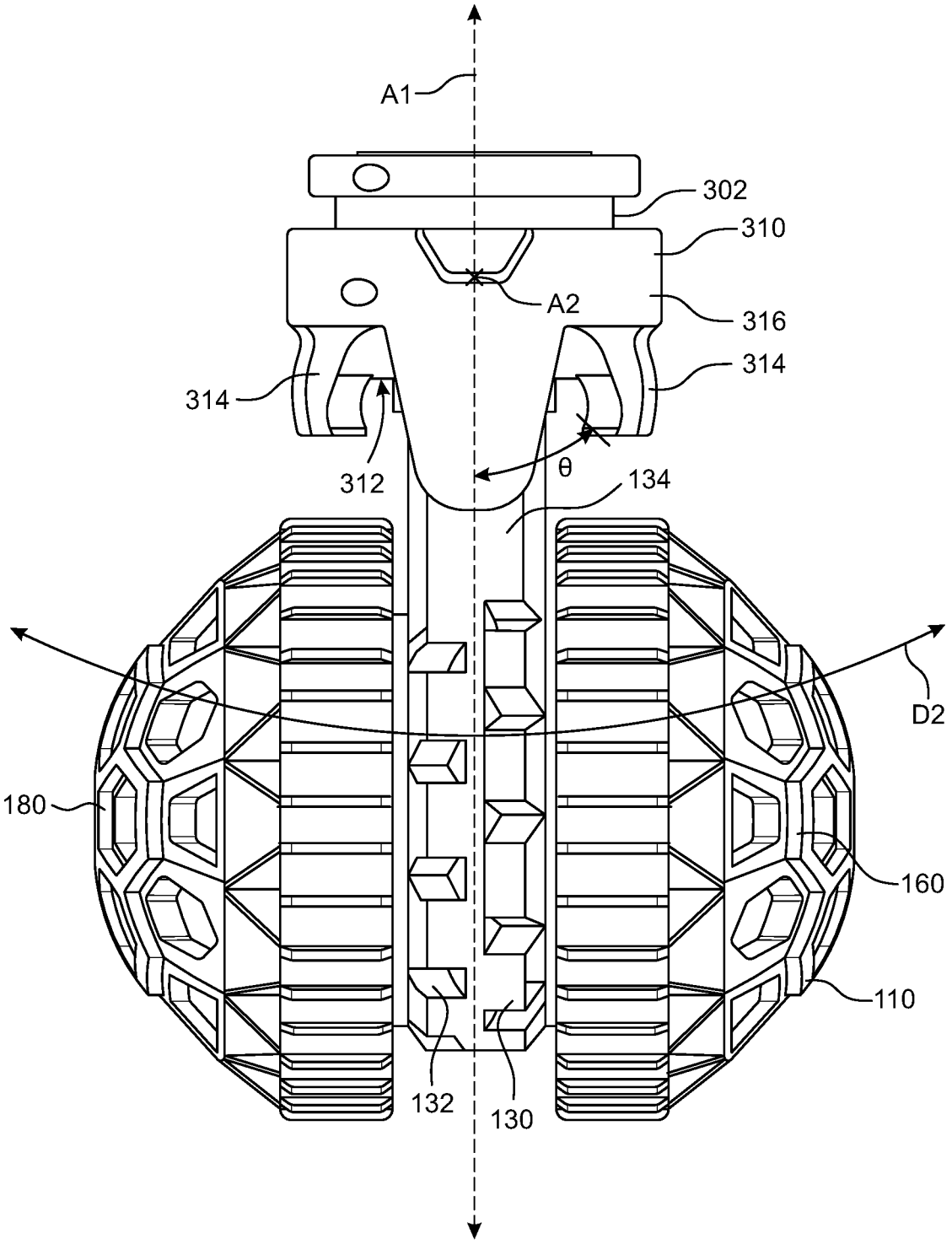
FIG. 7 illustrates a top view of a swiveling wheel assembly included in the RC vehicle of FIG. 1.

More specifically, wheel 160 and wheel 180 are mounted on hub 130 while wheel 260 and 280 are mounted on hub 230. Hub 130 includes a main or mounting portion 132 and a neck 134. The mounting portion 132 is configured to receive wheel 160 and wheel 180 on opposite sides thereof (i.e., wheel 160 and wheel 180 are mounted on an axle 112 extending through the mounting portion 132, which is shown in FIGS. 6 and 7). The neck 134 of the hub 130 is configured to mate with a receptacle 312 included in the first portion 310 of the main body 300. The hub 130 also includes a top 136 that is aligned with the top 316 of the first portion 310 of the main body 300. That is, the top 136 of the hub 130 is constantly facing the same direction as the top 316 of the first portion 310 of the main body 300 because the wheel assembly 110 is fixed to the first portion 310 with respect to the longitudinal axis A1.

Similarly, hub 230 includes a main or mounting portion 232 and a neck 234. The mounting portion 232 is configured to receive wheel 260 and wheel 280 on either side thereof (i.e., wheel 260 and wheel 260 are mounted on an axle 212 extending through the mounting portion 232, which is shown in FIG. 7) and the neck 234 of the hub 230 is configured to mate with the second portion 340 of the main body 300. The hub 230 also includes a top 236 that is aligned with the top 344 of the second portion 340 of the main body 300. That is, the top 236 of the hub 230 is constantly facing the same direction as the top 344 of the second portion 340 of the main body 300 (since the wheel assembly 210 is fixed to the second portion 340 with respect to the longitudinal axis A1).

Figure 3:
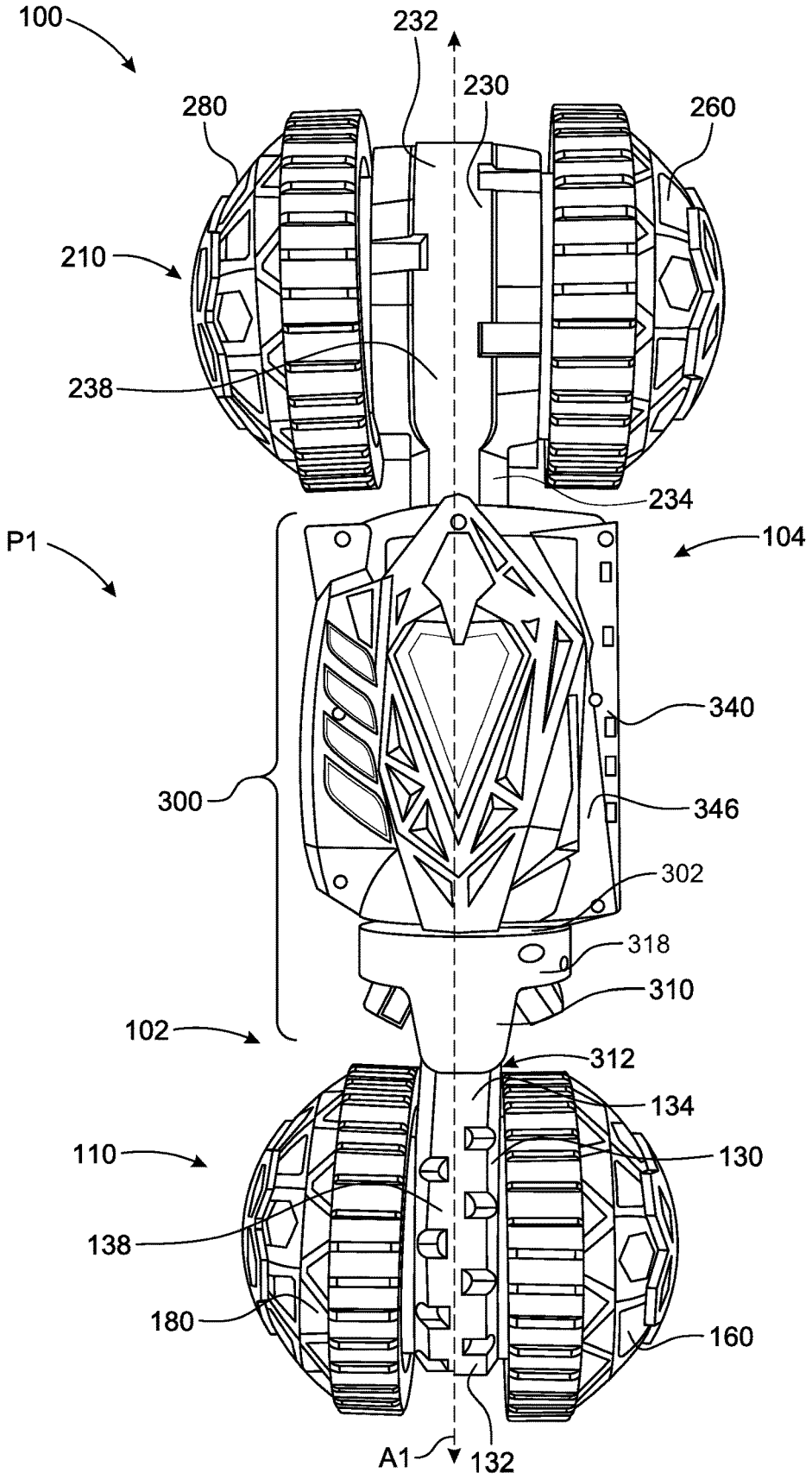
FIG. 3 illustrates a top view of the RC vehicle of FIG. 1 while the RC vehicle is in a second driving position.

In FIG. 3, the RC vehicle 100 is shown, from a top view, in a second driving position P2. In driving position P2, both the first assembly 102 and the second assembly 104 are upside down, such that a bottom 318 of the first portion 310, a bottom 346 of the second portion 340, a bottom 138 of the hub 130, and a bottom 238 of the hub 230 can all be seen in the top view provided by FIG. 3. Notably, the RC vehicle 100 looks substantially similar when in position P2 or position P1. That is, a bottom of the RC vehicle 100 is substantially similar to a top of the RC vehicle 100. However, the top and bottom may be aesthetically different to provide visual indications of a roll or tumble. For example, the top may be one color and the bottom may be another.

That being said, due, at least in part, to the similarity of the top and bottom of the RC vehicle 100, the RC vehicle 100 can operate (i.e., drive and execute stunts) in substantially the same manner regardless of the position or orientation of the first assembly 102 and the second assembly 104. That is, the RC vehicle 100 may drive with the front assembly 102 and/or the rear assembly 104 in nearly any orientation or position. For example, the RC vehicle 100 may drive with both the first assembly 102 and rear assembly 104 right side up (driving position P1) both the first assembly 102 and rear assembly 104 upside down (driving position P2, as shown in FIG. 3), with one of the first assembly 102 and rear assembly 104 right side up and the other upside down, or with assemblies 102 and 104 in any other positions. In order to provide simple steering controls throughout various driving positions, the front assembly 102 of the depicted embodiment may include a sensor or mechanism to detect the orientation of the front assembly 102, as is described below.

Figure 4:
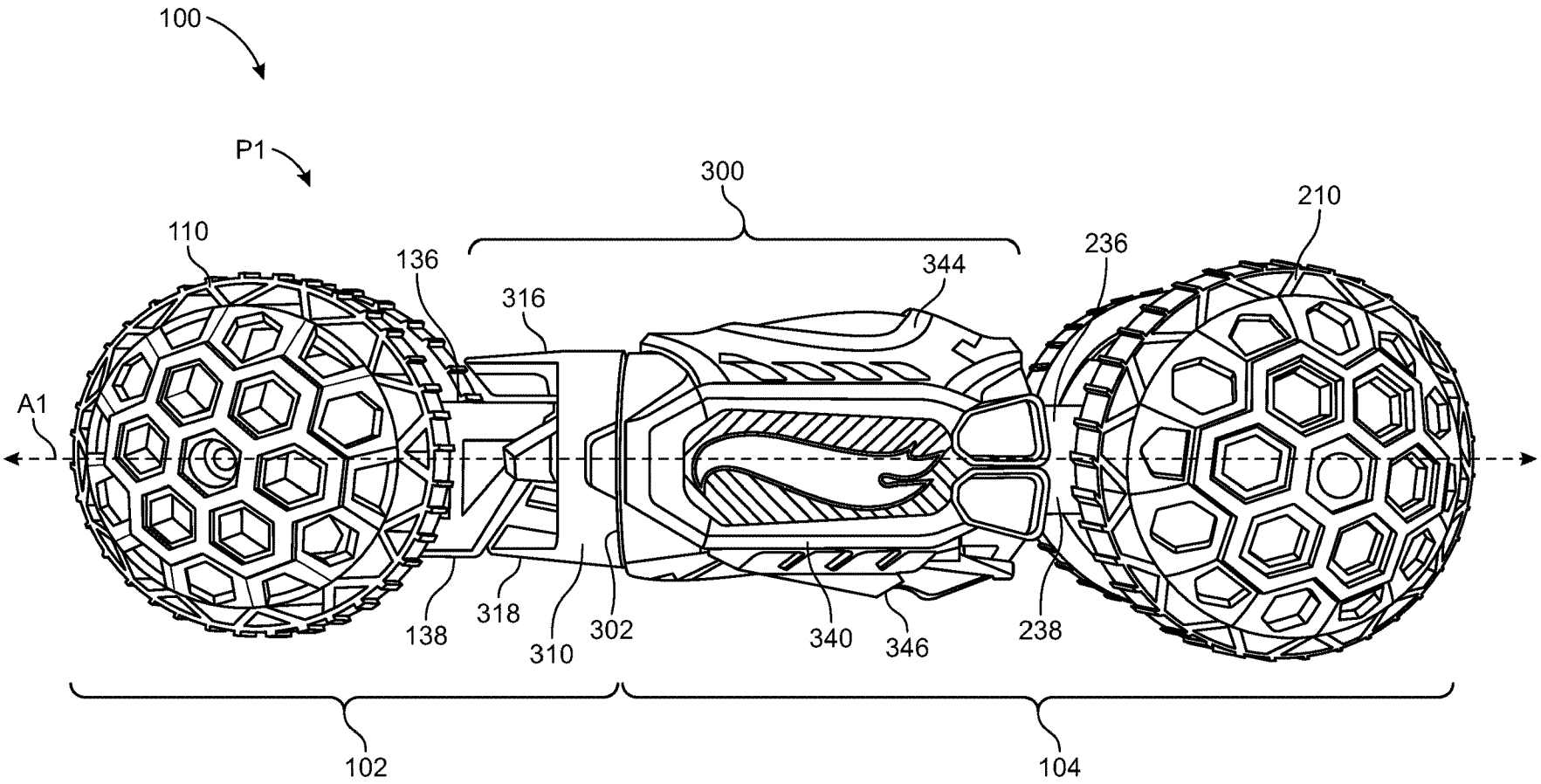
FIG. 4 illustrates a side view of the RC vehicle of FIG. 1 while the RC vehicle is in the first driving position.

FIG. 4 provides a side view of the RC vehicle 100 which further illustrates the similarity of the bottom of the RC vehicle 100 is and the top of the RC vehicle 100. In FIG. 4, the RC vehicle 100 is in the first driving position P1. However, as mentioned, during operation, the RC vehicle 100 may dynamically and seamlessly shift between driving position P1, driving position P2, other defined driving positions (such as a driving position with the first assembly 102 upside down and the second assembly 104 right side up, or vice versa), and any other positions or orientations. In defined driving positions, the front assembly 102 and the rear assembly 104 are substantially aligned and often parallel to a support surface on which the RC vehicle 100 is resting or moving. In some embodiments, the RC vehicle 100 may include detents, biasing, or other such features that encourage each of the front assembly 102 and rear assembly 104 to move into one of these defined position (i.e., a position where the assemblies are aligned). However, in at least some instances, each of the front assembly 102 and the rear assembly 104 may also be free to rotate 360 degrees about the longitudinal axis A1 with respect to the other assembly, even during operation (i.e., in the boosted mode).

Moreover, the RC vehicle 100 may also drive or travel along a support surface while the front assembly 102 and the rear assembly 104 (and, thus, the wheel assemblies 110, 210) are tilted or angled with respect to a support surface on which the RC vehicle 100 is traveling. That is, the RC vehicle may operate with wheel assembly 110 and wheel assembly 210 oriented at any roll angle. In fact, even if wheel assembly 110 and wheel assembly 210 are free to rotate about a roll axis (i.e., longitudinal axis A1) with respect to the main body 300 (instead of being fixed about the longitudinal axis A1 with respect to the main body 300, like the depicted embodiment), as may be the case in some embodiments, the RC vehicle 100 may still operate regardless of the angular orientation of wheel assembly 110 and wheel assembly 210. This continuous operation is supported, at least in part, by the shape of the wheels included in wheel assembly 110 and 210, which are described in connection with FIG. 5.

Figure 5:
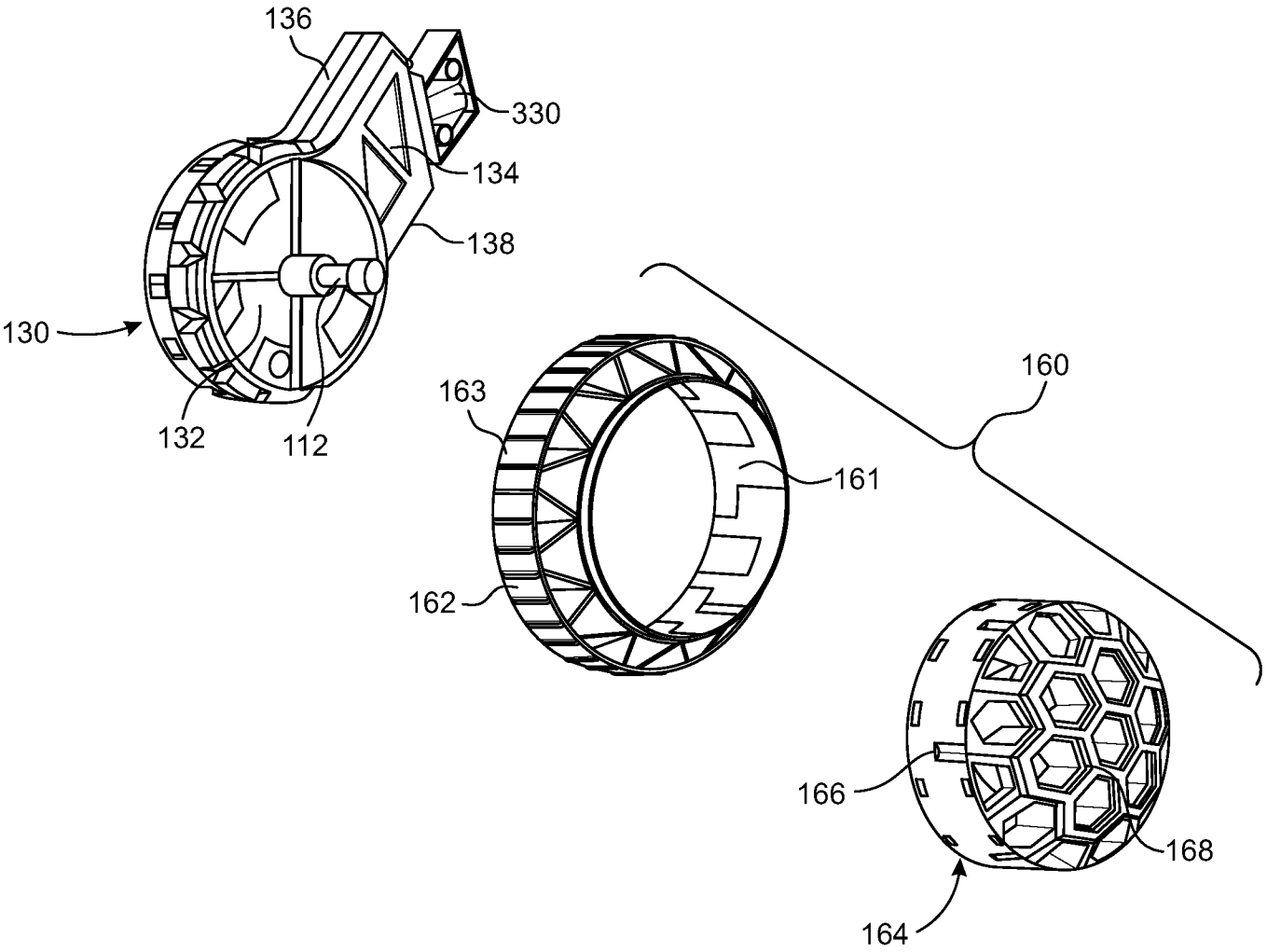
FIG. 5 illustrates an exploded, perspective view of a portion of a wheel assembly included in the RC vehicle of FIG. 1.

In FIG. 5, a portion of wheel assembly 110 is shown in an exploded view. For clarity, FIG. 5 only includes wheel 160; however, it is to be understood that wheel 160 is representative of any wheels included in RC vehicle 100 (i.e., wheel 180, wheel 260, and wheel 280) and, thus, any description of features or components of wheel 160 included below is to be understood to also apply to wheel 180, wheel 260, and wheel 280. By comparison, hub 130 and hub 230 include some substantially similar components, but also include different components and, thus are described individually. For example, the neck 134 of hub 130 includes a swivel mechanism 330 that swivably couples the neck 134 to the first portion 310 of the main body 300 while the neck 234 of hub 230 is fixedly coupled to the second portion 340 of the main body 300.

With that in mind, wheel 160 includes a wheel hub 164 and a tread 162. The wheel hub 164 includes an annular portion 166 and a hemispherical portion 168. Meanwhile, the tread 162 is substantially annular and, thus, includes an inner wall 161 and an outer wall 163 that are substantially concentric. The outer wall 163 is configured to grip a support surface and, thus, may include various features that increase the coefficient of friction between the outer wall 163 and a support surface (i.e., treads). The inner wall 161 is configured to mate with an outer surface of the annular portion 166 of the wheel hub 164 so that the tread extends around the wheel hub 164.

Still referring to FIG. 5, in this particular embodiment, the hemispherical portion 168 has a honeycomb-type structure and is manufactured from a somewhat resilient material, such as rubber. The shape and/or the material allow the hemispherical portion 168 to flex, at least minimally, when the hemispherical portion 168 engages a support surface. Thus, together, the hemispherical shape and resilient structure prevent the RC vehicle 100 from getting stuck on its side. For example, if one of the wheel assemblies is tilted with respect to the ground (i.e., angled with respect to driving position P1 or P2), the RC vehicle may continue to drive on the hemispherical portion 168 of the wheel or wheels closest to the ground. That being said, in other embodiments, the RC vehicle 100 may include wheel assemblies 110 and 210 with a single, substantially spherical wheel that is able to prevent the vehicle 100 from getting stuck on its side.

Turning next to FIG. 6, a sectional, perspective view of a portion of the RC vehicle 100 illustrates a drive mechanism 242, a tumbling or roll mechanism 370, and a swivel mechanism 330 included in the RC vehicle 100. The swivel mechanism 330 is generally configured to yaw the front wheel assembly 110 to steer the RC vehicle 100, as is described in further detail below in connection with FIG. 7. Meanwhile, the drive mechanism 242 is configured to drive or propel the RC vehicle 100 along a support surface (i.e., the ground) and the roll mechanism 370 is configured to roll the first assembly 102 with respect to the second assembly 104 (or vice versa, depending on the orientation and grip of assemblies 102 and 104).

The drive mechanism 242 is included in an interior cavity 240 of the hub 230 of the second wheel assembly 210 and is configured to drive the wheels (wheel 260 and wheel 280) of the second assembly on an axle 212 that extends centrally through wheel assembly 210. More specifically, the drive mechanism 242 includes a drive motor 244 that is coupled to a gear train 246. The gear train 246 is coupled to the axle 212 and is configured, through well-known mechanical coupling methods to impart motion from the motor 244 to the axle 212. The axle 212 is fixedly coupled to wheel 260 and wheel 280 and, thus, when the axle 212 is driven by motor 244, the axle 212 rotationally drives wheels 260 and 280 so that wheels 260 and 280 engage and rotate against a surface to create a driving or propelling force for the RC vehicle 100.

In this particular embodiment, the RC vehicle 100 only includes a drive mechanism 242 in the second wheel assembly 210 and, thus, the RC vehicle may be referred to as a rear-wheel drive RC vehicle (despite the RC vehicle 100 also being able to dive with the rear assembly 210 as the front of the RC vehicle 100). However, in other embodiments, the RC vehicle 100 may include front-wheel drive or four-wheel drive. That is, another drive mechanism may be included in the interior cavity 140 of the first wheel assembly, either in place of or in addition to the drive mechanism 242 included in the second wheel assembly 210.

Still referring to FIG. 6, the roll mechanism 370 is disposed within the main body 300 and, more specifically, is primarily disposed within the second portion 340 of the main body 300. Generally, the roll mechanism 370 is configured to generate a moment or torque that rolls or turns the first assembly 102 with respect to the second assembly 104 (i.e., while turning the vehicle in the boosted mode). More specifically, the roll mechanism 370 includes a roll motor 372 that is coupled to a gear train 378. The roll mechanism 370 also includes an axle 380 that extends longitudinally through the main body 300, between the first portion 310 and the second portion 340 (through joint 302). A nut 382 and a sensor 384 are each mounted on the axle 380.

The nut 382 is fixedly coupled to the axle 380 and the first portion 310 of the main body 300. Meanwhile, the axle 380 is configured to be driven, either clockwise or counterclockwise, by the roll motor 372 (via the gear train 378, which is fixedly coupled to the second portion 340 of the main body 300). Consequently, when the motor 372 imparts motion to the gear train 378, the gear train 378 imparts rotational motion to axle 380 that may rotate the first assembly 102 (via the nut 382) with respect to the second assembly 104. That is, activation of the roll motor 370 causes the first assembly 102 to roll about the longitudinal axis A1 (the first wheel assembly 110 and the first portion 310 both rotate about axis A1, since the first wheel assembly 110 is coupled to the first portion 310 in a manner that prevents roll rotation of the wheel assembly 110 with respect to the first portion 310). Alternatively, based on the grip and the position of assemblies 102 and 104, rotation of the axle 380 may rotate the second assembly 104 with respect to the first assembly 102. In other words, in at least some instances, rotational motion of the axle 380 may create a torque that drives the entire second portion 340 of the main body 300 (together with wheel assembly 210) around the axle 380.

Still referring to FIG. 6, the sensor 384 mounted on the axle 380 may be coupled to the nut 382 and, thus, may rotate with the nut 382 and the first assembly 102. Thus, the sensor 384 is positioned to determine the position of the front assembly 102 (and, thus, the position of the front wheel assembly 110). The operations of the controller 400 and/or the RC vehicle 100 may be adjusted based on feedback from the sensor 384 to ensure that steering controls provided by controller 400 (i.e., joystick 404) correspond to the configuration/position of the vehicle 100. For example, in the depicted embodiment, the joystick 404 is synced with the position of the orientation of the front wheel assembly 110 since the front wheel assembly 110 controls steering in the depicted embodiment.

More specifically, and now referring to FIG. 7, in the depicted embodiment, only the first wheel assembly 110 can rotate about a vertical axis, in in the directions denoted by arrow D2 to steer the RC vehicle 100. That is, the first wheel assembly 110 can yaw about axis A2 while the second wheel assembly 210 is fixed with respect to yaw rotation. This allows the first wheel assembly 110 to steer the RC vehicle 100. However, in other embodiments, wheel assembly 110 and/or wheel assembly 210 may control the steering of the RC vehicle 100.

To permit yaw movement of the first wheel assembly 110, the neck 134 of the first wheel assembly is coupled to the receptacle 312 of the first portion 310 of the main body 300 via a swivel mechanism 330 (see FIG. 6). In the depicted embodiment, the swivel mechanism 330 comprises a tension linkage. The tension linkage allows the wheel assembly 330 to rotate about a yaw axis A2 (see FIG. 1) in accordance with the directions denoted by arrow D2 as the roll mechanism 370 imparts rotation to the front assembly 102. Consequently, the wheel assembly 110 may turn (i.e., yaw) and steer the RC vehicle 100 through turns.

More specifically, when the RC vehicle 100 is in a normal operating mode, the roll mechanism 370 may be configured to rotate the front assembly 102 so that the wheel assembly 110 swivels about axis A2 with respect to the first portion 310 of the main body 300 without rolling about axis A1. For example, when the RC vehicle 100 is in a normal operating mode, the roll mechanism 370 may only be configured to rotate the axle 380 approximately 35 degrees in either direction. This rotation may cause the wheel assembly 110 to swivel about axis A2 without rolling about axis A1. By comparison, when the RC vehicle 100 is operating in the boosted mode, the roll mechanism 370 may be free to rotate the axle 380 through any number of rotations in either direction (i.e., 360 degrees or more clockwise or counter-clockwise). This may create more exciting driving scenarios, since the RC vehicle 100 may roll into turns instead of simply steering into turns. In fact, buttons 406 may be preprogrammed to cause the RC vehicle 100 to roll into a 180 degree turn or a 90 degree turn when the RC vehicle 100 is in the boosted mode.

Still referring to FIG. 7, in order to control the yaw range of the first wheel assembly 110, the receptacle 312 may be bounded by bumpers 314. These bumpers 314 are laterally aligned with the neck 134 of hub 130 so that the neck contacts a bumper 314 when the neck 134 moves a certain distance in either of the direction denoted by arrow D2. More specifically, the bumpers 314 may limit the angular movement of the neck 134 to a particular angle θ in either direction. The angle θ controls the turning radius of the RC vehicle 100 and may be configured as different angles in different embodiments to provide different turning features. For example, in some embodiments, the angle θ may be relatively small (i.e., 45 degrees) so that the RC vehicle can make at least some turns without the front assembly 102 rolling with respect to the rear assembly 104 (or vice versa). Alternatively, the angle θ may be configured so that a sharp turn (i.e., a turn corresponding to a movement of the joystick 404 to either of its lateral bounds) always causes the front assembly 102 to roll with respect to the rear assembly 104 (due to the momentum of the front assembly 102).

Figure 8:
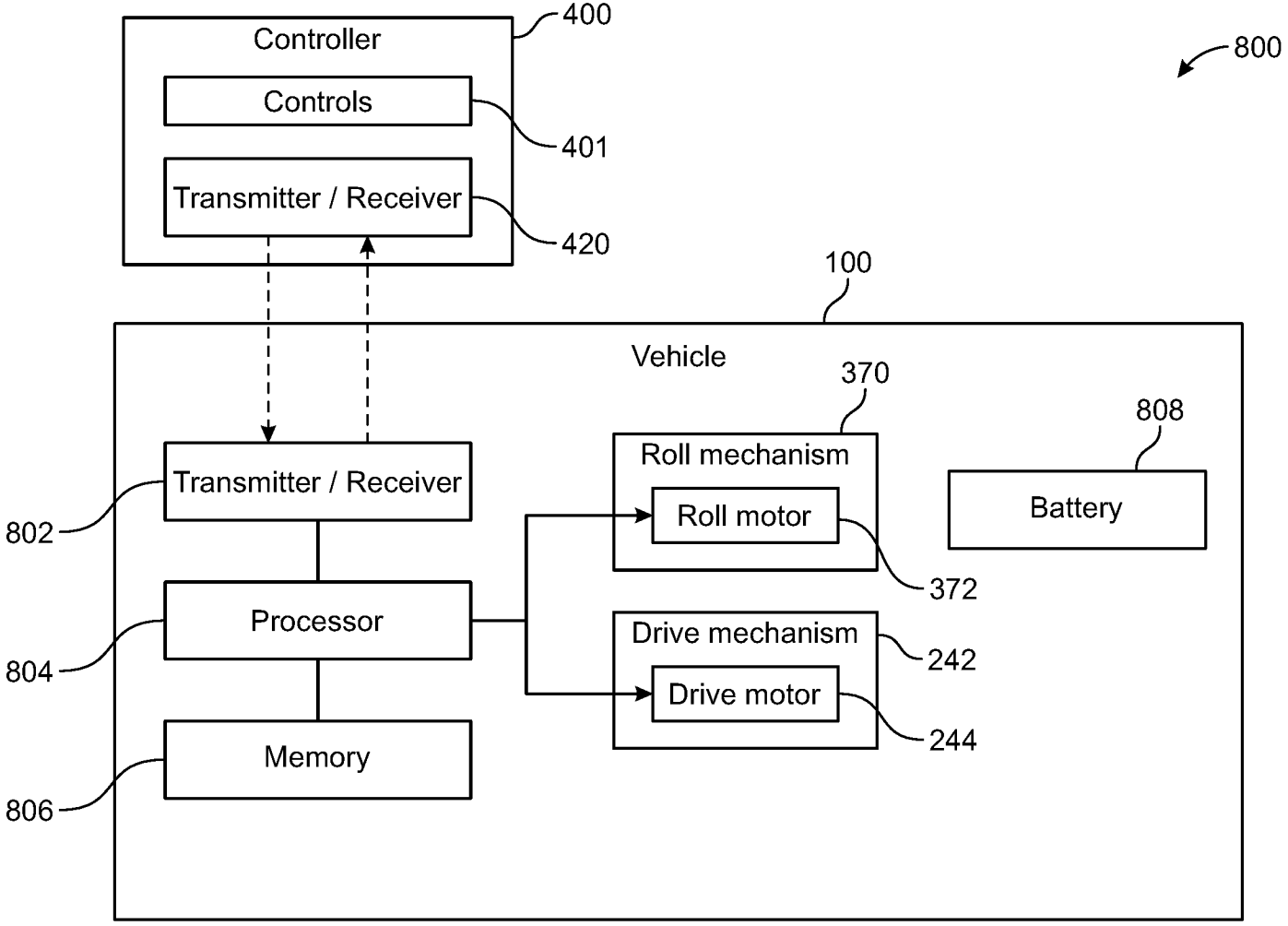
FIG. 8 is a block diagram illustrating a high-level schematic of the RC vehicle and accompanying controller of FIG. 1.

Now referring to FIG. 8, a high-level schematic diagram 800 of the various mechanisms, modules, and electronics included in the RC vehicle 100 is illustrated according to an example embodiment. In this example embodiment, the controller 400 includes a plurality of controls 401 (such as joysticks 402 and 404 and roll buttons 406, as shown in FIG. 1) and a transmitter/receiver 420 configured to transmit signals relating to any control actions input at controls 401 to the RC vehicle 100. Meanwhile, the RC vehicle 100 includes a transmitter/receiver 802, a processor 804, a memory 806, and a battery or power source 808 that are collectively configured to operate the roll mechanism 370 and the drive mechanism 242.

The transmitter/receiver 802 is generally configured to communicate with the transmitter/receiver 420 so that the controller 400 can drive the RC vehicle 100 and receive feedback from the RC vehicle (i.e., feedback from the wiper mechanism 384 to determine the steering orientation of the vehicle). For example, the transmitter/receiver 420 and transmitter/receiver 802 may be connected through a wireless communication channel or protocol, such as BLUETOOTH®, or any other known form of wireless communication feasible between a controller and a RC vehicle. The processor 804 is connected to the mechanisms included in the vehicle 100 (i.e., the roll mechanism 370, and the drive mechanism 242) and is generally configured to control these mechanisms based on signals received from the controller 400 (at the transmitter/receiver 802) and/or instructions stored in memory 806. The battery 808 is generally configured to supply power to any mechanisms or components in the vehicle 100 that require power (i.e., the processor 804, the roll mechanism 370, and the drive mechanism 242).

More specifically, although diagram 800 shows a signal block 802 for the processor, it should be understood that the processor 802 may represent a plurality of processing cores, each of which can perform separate processing. Meanwhile, memory 806 may include random access memory (RAM) or other dynamic storage devices (i.e., dynamic RAM (DRAM), static RAM (SRAM), and synchronous DRAM (SD RAM)), for storing information and instructions to be executed by processor 802. The memory 806 may also include a read only memory (ROM) or other static storage device (i.e., programmable ROM (PROM), erasable PROM (EPROM), and electrically erasable PROM (EEPROM)) for storing static information and instructions for the processor 802. Although not shown, the vehicle 100 may include a bus or other communication mechanism for communicating information between the processor 802 and memory 806

The processor 802 may also include special purpose logic devices (i.e., application specific integrated circuits (ASICs)) or configurable logic devices (i.e., simple programmable logic devices (SPLDs), complex programmable logic devices (CPLDs), and field programmable gate arrays (FPGAs)), that, in addition to microprocessors and digital signal processors may individually, or collectively, are types of processing circuitry. The processing circuitry may be located in one device or distributed across multiple devices.

The controller 802 performs a portion or all of the processing steps required to control the RC vehicle 100 in response to instructions received at transmitter/receiver 802 and/or instructions contained in a memory 806. Such instructions may be read into memory 806 from another computer readable medium. One or more processors in a multi-processing arrangement may also be employed to execute the sequences of instructions contained in memory 806. In alternative embodiments, hard-wired circuitry may be used in place of or in combination with software instructions. Thus, embodiments are not limited to any specific combination of hardware circuitry and software.

Put another way, the vehicle 100 includes at least one computer readable medium or memory for holding instructions programmed according to the embodiments presented, for containing data structures, tables, records, or other data described herein. Examples of computer readable media are compact discs, hard disks, floppy disks, tape, magneto-optical disks, PROMs (EPROM, EEPROM, flash EPROM), DRAM, SRAM, SD RAM, or any other magnetic medium, compact discs (i.e., CD-ROM), or any other optical medium, or any other medium from which a computer can read.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

Additionally, it is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

What is claimed is:

1. A remotely controlled toy vehicle, comprising:

a first wheel assembly including two wheels and a hub with a neck, the two wheels being mounted on opposite sides of the hub and the neck extending from the hub in a direction parallel to the opposite sides;

a second wheel assembly;

a drive mechanism configured to drive at least one of the first wheel assembly and the second wheel assembly; and a main body including a first portion and a second portion disposed between the first wheel assembly and the second wheel assembly, wherein the neck of the first wheel assembly is swivably coupled to a front end of the first portion of the main body so that the first wheel assembly can yaw about a vertical axis extending through the main body, the second wheel assembly is coupled to a back end of the second portion of the main body, and a back end of the first portion is coupled to a front end of the second portion at a rotation joint; and a tumbling mechanism configured to roll the first wheel assembly with respect to the second wheel assembly at the rotation joint.

2. The remotely controlled toy vehicle of claim 1, wherein the drive mechanism is disposed in the first wheel assembly or the second wheel assembly.

3. The remotely controlled toy vehicle of claim 2, wherein the drive mechanism is disposed in the second wheel assembly and operable to propel the remotely controlled toy vehicle regardless of an orientation of the first wheel assembly with respect to the second wheel assembly.

4. The remotely controlled toy vehicle of claim 1, wherein the first wheel assembly may be swiveled to steer the remotely controlled toy vehicle.

5. The remotely controlled toy vehicle of claim 1, wherein the second wheel assembly is fixed to the second portion with respect to a longitudinal axis of the remotely controlled toy vehicle and the first wheel assembly is fixed to the first portion with respect to the longitudinal axis so that, in rolling the first wheel assembly, the tumbling mechanism rolls the first wheel assembly and the first portion with respect to the second wheel assembly and the second portion.

6. The remotely controlled toy vehicle of claim 1, wherein the drive mechanism includes a drive motor and the tumbling mechanism includes a roll motor.

7. A remotely controlled toy vehicle, comprising:

a front assembly including at least one first wheel that is coupled to a front end of a first portion of a main body so that the at least one first wheel rotates about a longitudinal axis of the main body with the first portion of the main body;

a rear assembly including at least one second wheel coupled to a back end of a second portion of the main body so that the at least one second wheel rotates about the longitudinal axis of the main body with the second portion of the main body, wherein a back end of the first portion of the main body is rotatably coupled to a front end of the second portion of the main body at a rotation joint;

a drive mechanism including a drive motor configured to drive one or more of the at least one first wheel of the front assembly and the at least one second wheel of the rear assembly in order to propel the remotely controlled toy vehicle along a surface when the remotely controlled toy vehicle is in at least: (1) a first driving position in which the front assembly and the rear assembly are both oriented in first orientations; and (2) a second driving position in which the front assembly and the rear assembly are both oriented in second orientations that are upside down with respect to their first orientations; and a roll mechanism including a roll motor configured to roll one of the front assembly and the rear assembly about the longitudinal axis with respect to the other of the front assembly and the rear assembly at the rotation joint.

8. The remotely controlled toy vehicle of claim 7, wherein the drive mechanism is disposed in either a wheel of the at least one first wheel of the front assembly or a wheel of the at least one second wheel of the rear assembly.

9. The remotely controlled toy vehicle of claim 8, wherein the drive mechanism is disposed in the wheel of the rear assembly and is operable to propel the remotely controlled toy vehicle when the front assembly is in its first orientation or its second orientation, regardless of whether the rear assembly is in its first orientation or its second orientation.

10. The remotely controlled toy vehicle of claim 7, wherein the at least one first wheel of the front assembly is swivably coupled to the first portion of the main body and may be swiveled to steer the remotely controlled toy vehicle.

11. The remotely controlled toy vehicle of claim 1, wherein the drive mechanism includes a drive motor and the tumbling mechanism includes a roll motor.

12. The remotely controlled toy vehicle of claim 1, wherein the two wheels of the first wheel assembly are two first wheels, the hub of the first wheel assembly is a first hub, the neck of the first wheel assembly is a first neck, and the second wheel assembly further comprises:

two second wheels; and a second hub with a second neck, the two second wheels being mounted on opposite sides of the second hub and the second neck extending from the second hub in a direction parallel to the opposite sides of the second hub.

13. The remotely controlled toy vehicle of claim 7, wherein the at least one first wheel of the front assembly comprises two wheels and the front assembly further comprises:

a hub with a neck, the two wheels being mounted on opposite sides of the hub and the neck extending from the hub in a direction parallel to the opposite sides.

14. The remotely controlled toy vehicle of claim 13, wherein the two wheels of the front assembly are two first wheels, the hub of the front assembly is a first hub, the neck of the front assembly is a first neck, and the rear assembly further comprises:

two second wheels; and a second hub with a second neck, the two second wheels being mounted on opposite sides of the second hub and the second neck extending from the second hub in a direction parallel to the opposite sides of the second hub.

15. The remotely controlled toy vehicle of claim 1, wherein the two wheels of the first wheel assembly each include a hemispherical portion.

16. The remotely controlled toy vehicle of claim 15, wherein the hemispherical portion has a honeycomb-type structure.

17. The remotely controlled toy vehicle of claim 15, wherein each of the two wheels of the first wheel assembly further comprises:

an annular portion positioned interiorly of the hemispherical portion; and a tread mounted on the annular portion.

18. The remotely controlled toy vehicle of claim 7, wherein the at least one first wheel and the at least one second wheel each include a hemispherical portion.

19. The remotely controlled toy vehicle of claim 18, wherein the hemispherical portion has a honeycomb-type structure.

20. The remotely controlled toy vehicle of claim 19, wherein the at least one first wheel and the at least one second wheel each further comprise:

an annular portion positioned interiorly of the hemispherical portion; and a tread mounted on the annular portion.

* * * * *